US007489280B2

(12) United States Patent
Aminzadeh et al.

(10) Patent No.: US 7,489,280 B2
(45) **Date of Patent: *Feb. 10, 2009**

(54) ANTENNA MODULE

(75) Inventors: Mehran Aminzadeh, Braunschweig (DE); Meinolf Schafmeister, Hildesheim (DE); Florian Scherbel, Eildesheim (DE); Keno Mennenga, Braunschweig (DE)

(73) Assignee: RecepTec GmbH, Hildesheim (DE)

( * ) Notice: Subject to any disclaimer, the term of this patent is extended or adjusted under 35 U.S.C. 154(b) by 288 days.

This patent is subject to a terminal disclaimer.

(21) Appl. No.: 11/494,533

(22) Filed: Jul. 28, 2006

(65) Prior Publication Data

US 2006/0273969 A1 Dec. 7, 2006

Related U.S. Application Data

(63) Continuation of application No. 11/185,015, filed on Jul. 20, 2005, now abandoned.

(30) Foreign Application Priority Data

Jul. 20, 2004 (DE) ..... 10 2004 035 064

(51) Int. Cl.
*H01Q 1/32* (2006.01)
*H01Q 1/38* (2006.01)

(52) U.S. Cl. ..... 343/713; 343/700 MS; 343/846

(58) Field of Classification Search ..... 343/711, 343/713, 700 MS, 848
See application file for complete search history.

(56) References Cited

U.S. PATENT DOCUMENTS 4,089,003 A 5/1978 Conroy (Continued)

FOREIGN PATENT DOCUMENTS

DE 101 33 295 A1 1/2003

(Continued)

OTHER PUBLICATIONS

Goving V et al: "Design of multiband baluns on liquid crystalline polymer (LCP) based substrates" Electronic Components and Technology, 2004. ECTC -04. Proceedings Las Vegas, NV, USA Jun. 1-4, 2004, Piscataway, NJ, USA, IEEE, vol. 2, Jun. 1, 2004, pp. 1812-1818, XPO10715244 ISBN: 0-7803-8365-6 *abstract* *figures 1-3* *p. 1812, col. 1, paragraph 2—p. 1618, col. 1, paragraph 2*, 7 pages.

(Continued)

*Primary Examiner*—Tan Ho
(74) *Attorney, Agent, or Firm*—Harness, Dickey & Pierce, P.L.C.

(57) ABSTRACT

Antenna module for frequencies in the GHz-range mountable on vehicles features a wide range of functions. Module includes a lower patch-antenna with a lower dielectric substrate. A lower λ/2-antenna structure is on the upper surface of the lower substrate for reception of satellite-transmitted frequencies in the GHz range, and a metallization is on the lower surface of the lower substrate. An upper patch-antenna of smaller dimensions and with an upper dielectric substrate is on the lower patch-antenna. An upper λ/2-antenna structure for reception of satellite-transmitted frequencies in the GHz-range is on the upper surface of the upper substrate. A metallization is below the upper substrate. A lower antenna connector runs from the lower λ/2-antenna structure through the lower substrate. An upper antenna connector separate from the lower antenna connector runs from the upper antenna structure through the upper substrate and the lower patch antenna.

23 Claims, 4 Drawing Sheets

U.S. PATENT DOCUMENTS

| | | | |
|---|---|---|---|
| 4,132,995 | A | 1/1979 | Monser |
| 4,218,682 | A | 8/1980 | Yu |
| 4,401,988 | A | 8/1983 | Kaloi |
| 4,827,271 | A | 5/1989 | Berneking et al. |
| 4,873,529 | A | 10/1989 | Gibson |
| 5,003,318 | A | 3/1991 | Berneking et al. |
| 5,121,127 | A | 6/1992 | Toriyama |
| 5,153,600 | A | 10/1992 | Metzler et al. |
| 6,008,770 | A | 12/1999 | Sugawara |
| 6,087,990 | A | 7/2000 | Thill et al. |
| 6,118,406 | A | 9/2000 | Josypenko |
| 6,181,281 | B1 | 1/2001 | Desclos et al. |
| 6,329,959 | B1 | 12/2001 | Varadan et al. |
| 6,466,768 | B1 | 10/2002 | Agahi-Kesheh et al. |
| 6,538,609 | B2 | 3/2003 | Nguyen et al. |
| 6,639,558 | B2 | 10/2003 | Kellerman et al. |
| 6,762,729 | B2 | 7/2004 | Egashira |
| 6,806,838 | B2 | 10/2004 | Petros et al. |
| 6,850,191 | B1 | 2/2005 | Thill et al. |
| 6,906,669 | B2 | 6/2005 | Sabet et al. |
| 6,930,639 | B2 | 8/2005 | Bauregger et al. |
| 7,019,705 | B2 | 3/2006 | Pfletschinger et al. |
| 7,030,824 | B1 | 4/2006 | Taft et al. |
| 7,084,815 | B2 | 8/2006 | Phillips et al. |
| 7,116,952 | B2 | 10/2006 | Arafa |
| 7,164,385 | B2 | 1/2007 | Duzdar |
| 7,202,818 | B2 | 4/2007 | Anguera Pros et al. |
| 7,245,261 | B2 | 7/2007 | Zafar et al. |
| 7,277,056 | B1 | 10/2007 | Thiam et a. |
| 7,295,167 | B2 * | 11/2007 | Aminzadeh et al. ..... 343/713 |
| 2003/0052825 | A1 | 3/2003 | Rao et al. |
| 2004/0051661 | A1 | 3/2004 | Wixforth et al. |
| 2004/0051675 | A1 | 3/2004 | Inoue |
| 2004/0056803 | A1 | 3/2004 | Soutiaguine et al. |
| 2004/0072575 | A1 | 4/2004 | Young et al. |
| 2004/0075610 | A1 | 4/2004 | Pan |
| 2004/0090367 | A1 | 5/2004 | Montgomery et al. |
| 2004/0104858 | A1 | 6/2004 | Pfletschinger et al. |
| 2004/0183735 | A1 | 9/2004 | Jecko et al. |
| 2005/0215194 | A1 | 9/2005 | Boling et al. |
| 2006/0097924 | A1 | 5/2006 | Yegin et al. |
| 2006/0103576 | A1 | 5/2006 | Mahmoud et al. |
| 2006/0205369 | A1 | 9/2006 | Schaich et al. |
| 2006/0220970 | A1 | 10/2006 | Aminzadeh et al. |
| 2006/0273969 | A1 | 12/2006 | Aminzadeh et al. |

FOREIGN PATENT DOCUMENTS

| | | | |
|---|---|---|---|
| EP | 0 188 087 | A1 | 7/1988 |
| EP | 0 323 664 | A2 | 12/1988 |
| EP | 0 188 087 | B1 | 9/1990 |
| EP | 0 521 384 | A1 | 1/1993 |
| EP | 1 249 892 | A2 | 10/2002 |
| EP | 1249892 | A3 | 10/2002 |
| EP | 1357636 | | 10/2003 |
| EP | 1619752 | | 1/2006 |
| JP | 63004723 | | 9/1988 |
| JP | 2000165135 | | 6/2000 |
| WO | WO 01/03235 | A1 | 1/2001 |
| WO | WO 02/49151 | | 6/2002 |

OTHER PUBLICATIONS

Hossein Hashemi et al: "Concurrent Multiband, Low-NoiseAmplifiers- Theory, Design and Applications" IEEE Transactions on Microwave Theory and Techniques, IEEE Service Center, Piscataway, NJ, US, vol. 50, No. 1, Jan. 2002, XPO11038576 ISSN: 0018-9480 *abstract* *figures 2, 3* *p. 288, col. 1, paragraph 3- col. 2, paragraph 3* *p. 3, col. 1, paragraph 2—p. 4, col. 1, paragraph 3*, 14 pages.

S. Maci and G. Biffi Gentili, "Dual-Frequency Patch Antennas," IEEE Antennas and Propagation Magazine, Bd. 39, Nr 6, Dec. 1997, pp. 13-20.

Handbook of Microstrip Antennas, 1989, pp. 318-320.

"Build This No-Tune Dual-Band Feed for Mode L/S", The Armstrong Journal, Jan./Feb. 2002, 7 pages.

E.B. Perri, "Dual band cellular antenna in a multifunction platform for vehicular applications", 2006 IEEE, University of Sao Paulo - Dept. of Telecommunications and Control Engineering Av. Prof. Luciano Gualberto, trav. 3, 158 ZC 05508-900 Sao Paulo, Brazil (2006) pp. 2361-2364.

European Search Report dated Mar. 9, 2006 in European Application No EP 05 01 5079.6 (6 pages).

German Patent Office Action dated Jun. 3, 2005 in German Application No. 10 2004 035 064.7-55, filed Jul. 20, 2004 ( 4 pages).

Multi-Layer Parasitic Microstrip Array Antenna on LTCC Substrate for Millimeter-Wave System-on-Package, Seki, T. Nishikawa, K. Cho, K., NTT Network Innovation Lab., NTT Corp., Kanagaway, Japan; 33rd Microwave Conference, 2003. vol. 3, pp. 1393-1396.

Half-wave Stacked Patch Antenna with Dielectric Feed, Voipio, V. Ollikainne, J. Vainikainen, P., IRC Radio Lab., Helsinki Univ. of Technol., Espoo; Antennas and Propagation Society International Symposium, 1999. IEEE Publication Date: Aug. 1999, vol. 4, pp. 2466-2469.

Novel Probe-Feeding Architectures for Stacked Microstrip Patch Antennas, Kona, K.S.. Rahmat-Samii, Y., Dept. of Electr. Eng., California Univ., Los Angeles, CA, USA, Microwave and Optical Technology Letters, vol. 38, No. 6, pp. 467-475, Publisher: Wiley, Aug. 11, 2003.

* cited by examiner

ANTENNA MODULE

CROSS-REFERENCE TO RELATED APPLICATION

This application is a continuation of application Ser. No. 11/185,015, filed Jul. 20, 2005, now abandoned which claims the priority of German application no. 10 2004 035 064.7, filed Jul. 20, 2004, and each of which is incorported herein by reference.

ANTENNA MODULE

The invention relates to an antenna module for frequencies in the GHz-range to be affixed to a motor vehicle.

BACKGROUND OF THE INVENTION

An antenna module of this type integrates various functions of vehicle roof antennae. There are known microstrip-patch-antennae, that include a substrate, which in turn features metallization of the entire area of its lower surface and a suitable metallic structure or antenna structure on its upper surface. Antennae of this type commonly have a very narrow frequency bandwidth, for example, 1% to 2% relative bandwidth, unless additional measures are taken. By employing parasitic elements, bandwidth can be increased or multiple frequency bands can be blocked. These parasitic elements are conduction or surface structures, which are present on the same or higher plane than that of the antenna structure. If the parasitic elements are on a higher antenna structure, then they are coupled to the lower antenna structure, wherein a common HF-connection cable on the lower antenna structure runs to an amplification unit. In the parasitic elements, high frequency currents are induced, which adapt to the shape and dimensions of the parasitic elements and thereby produce fields. As a result, the entire structure has the capacity to send and receive both neighboring as well as somewhat distantly spaced frequencies.

Antenna structures of this type are only suitable, if the entirely expanded frequency band is allocated for the same service.

As a rule, if multiple, independent services are intended, then antenna modules with separately built antenna elements arranged next to one another are then used. In this configuration, however, more space is required. Furthermore, for the proper function of the individual antennae elements, sufficient isolation is required.

EP 0 521 384 A1 describes an antenna module with an upper and lower substrate, whereby an upper λ/2-antenna structure is present on the upper substrate and a lower λ/2-antenna structure is present on the lower substrate. In both antenna structures a metal layer present beneath the lower substrate serves as reference plane, facilitating a parallel connection of the oscillating circuits of both antennae.

OBJECTS AND SUMMARY OF THE INVENTION

An object of the invention is to provide an antenna module that ensures a compact construction and versatile range of functions with high reliability.

According to the invention, this object is achieved in an antenna module as claimed in Claim 1. The dependent claims describe preferred further embodiments.

According to the invention, two λ/2-patch-antennae of differing size are placed one on top of the other and connected separately. To provide effective radiation patterns, the lower patch antenna is larger than the upper patch antenna. The patch-antennae include their own separate substrate materials, on the respective upper surfaces of which the appropriate λ/2 antenna structures are provided, while the respective lower surfaces of which include metallization or abut a metallization. In this manner, it is axiomatic that both substrates can include metallization of their lower surfaces. In an embodiment of this type, an additional dielectric material, for example, can in principle be present between the lower metallization of the upper patch-antenna and the antenna structure of the lower patch-antenna.

In accordance with an advantageous embodiment, however, the lower surface of the upper substrate includes no metallization, given that, owing to the layered construction, that element rests on or is provided directly on the metallic antenna structure of the lower patch antenna, which serves as its own metallization. This entails no functional disadvantages; in particular, no coupling of the antennae is provided in this instance.

According to the invention the patch antennae arranged one-over-the-other are isolated/decoupled. Moreover—unlike, for example, in EP 0 521 384 A1 described earlier—both metallizations of the patch-antennae are provided as separate components. That is, the lower metallization of the lower patch antenna and the metallization of the upper patch antenna and/or the operative antenna structure of the lower antenna are provided as separate components. Unlike in EP 0 521 384 A1, in accordance with the present invention the focus is less on the creation of a broadband system than on the creation of a configuration of two isolated antennae.

Furthermore—unlike most of the prior art antenna modules equipped with λ/4 antenna elements for reception of terrestrial signals—in accordance with the invention λ/2—antenna elements and antenna structures are provided. They are hereby configured for satellite reception; that is, signals with circular polarization below an elevation angle of about 30° to 90° relative to the horizon. In contrast to conventional antenna structures, in which parasitic elements, when present, are provided above the base structure of the antenna and are which are directly coupled to the lower antenna structure, the present invention includes a separate cable connection for the separate upper λ/2-Antenna structure.

The signals are preferably conducted via a coaxial cable connection. The preferable coaxial cable connection can be provided on the lower metallization of the lower patch antenna or can be provided on a printed circuit board present in this area. To achieve the same reference potential for the metallizations of the two patch antennae, an interlayer connection running through the lower patch antenna can be present, which provides a galvanic connection between the two metallizations or between the antenna structure of the lower patch antenna serving as a metallization of the upper patch antenna and the metallization of the lower patch antenna. This interlayer connection is preferably provided in the middle of the λ/2-antenna structure, since it is at that point that the maximum current distribution and correspondingly minimum voltage is present. Therefore, the lateral middle portion of the antenna structure can be short-circuited without compromising the current distribution and field distribution.

The inventive antenna module can be used, for example, for receiving GPS signals in L-band, that is, at 1,575 MHz, and satellite digital radio services DAB WorldStar (WorldSpace) in Africa and Asia at 1,467 MHz to 1,492 MHz as well as DMB (Digital Multimedia Broadcasting) in the Far East-Asia at 2,630 MHz to 2,655 MHz and SDARS (Satellite Digital Audio Reception System) at 2,320 MHz to 2,345

MHz in the US. The range of frequency bands can be selected for the upper and lower patch antennae by adjusting the dimensions of the antenna structures. Furthermore, the dielectric material of the substrate can be changed accordingly to achieve the proper frequency bands. As a result, the upper, smaller patch antenna can be made to cover the smaller frequencies, if the upper substrate is provided with a correspondingly higher dielectric constant than that of the lower substrate.

In addition to receiving satellite signals, the patch-antennae can also receive terrestrial signals. For example, the lower patch-antenna can be employed to receive terrestrial SDARS signals. In an advantageous configuration, the upper patch antenna is employed for GPS reception.

In an advantageous embodiment of the invention, active patch-reception antennae are provided, whereby a low-noise amplifier (LNA) is integrated at the base of the antenna. Advantageously, the low-noise amplifiers are provided on the lower surface of a printed circuit board, on the upper surface of which the lower patch-antenna is provided. Furthermore, one of the low-noise amplifiers can be provided on one printed circuit board, while the other can be provided on a separate printed circuit board. Furthermore, only portions of a low-noise amplifier can be present on a separate printed circuit board, and this separate portion preferably contains the DC power supply and/or control, thereby allowing the connection of both printed circuit boards to be realized through a simple wire connection, e.g. a wire pin.

The inventive antenna module can also include a terrestrial antenna, e.g. a (multiband-) monopole or a (multiband-) rod antenna for, for example, telephone signals, AM/FM or terrestrial DAB in L-Band (1452 MHz to 1492 MHz) as well as Band III (170 MHz to 230 MHz). The terrestrial antennae can be situated in front of, behind, or on the patch-antenna stack, preferably aft thereto in the direction of travel.

If both patch antennae are combined with a telephone antenna, it is advantageous if the amplifiers include a suitable filter technology, which suppresses the relatively strong transmission signal of the telephone antenna at the input of the amplifier. In this way, the amplifier or the separate amplifiers can be protected from saturation effect.

Furthermore, the antenna module can be provided as an antenna array with a plurality of elements from both the upper and lower patch antennae. The elements in the groups can serve as transmission and/or reception antennae.

The antenna module can serve as a transmission and reception antenna, one of the two patch antennae functioning as the transmission antenna, and the other functioning as the reception antenna. This is especially useful in an antenna array, in which in each stack one of the two antennae serves as a transmission antenna, while the other serves as a reception antenna.

BRIEF DESCRIPTION OF THE DRAWINGS

The invention is described in further detail below with reference made to the attached drawings of several embodiments.

DETAILED DESCRIPTION OF THE INVENTION

Figure 1:
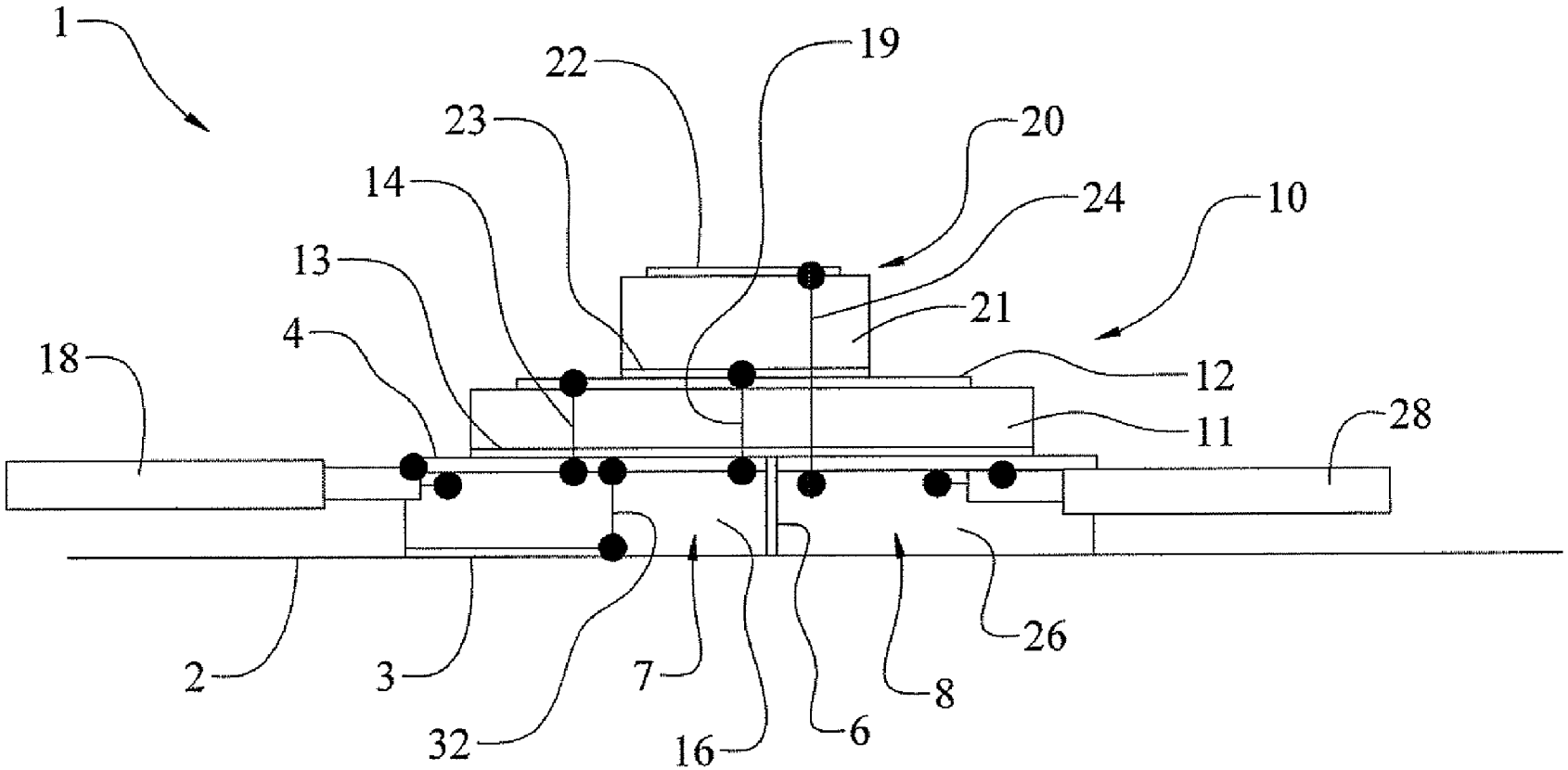
FIG. 1 shows the construction of an antenna module according to a first embodiment with amplifiers provided on a common printed circuit board.

An antenna module 1 shown in FIG. 1 includes a ground plane 2, which can be provided as a metal plate, for example, a lower printed circuit board 3 disposed on the ground plane 2, and an upper printed circuit board 4 parallel to and above the printed circuit board 3. Between the upper printed circuit board 4 and the ground plane 2 are amplification chambers 7 and 8, which are laterally separated and electromagnetically shielded by a metallic wall 6. In particular, they can constitute parts of a common amplification chamber, which is divided by the metallic wall 6.

On the upper printed circuit board 4 a lower patch antenna 10 is mounted, and which includes a lower substrate 11 made of a dielectric material, for example, a ceramic, and a lower λ/2-antenna structure 12 disposed on the upper surface of the lower substrate 11 and a lower metallization 13 covering the entire area of the lower surface of the lower substrate 11. The lower λ/2-antenna structure 12 is connected via an interlayer connection 14 running through the lower substrate 11 to a low-noise amplifier (LNA) 16, which is present in the left amplification chamber 7, located on the lower surface of the upper printed circuit board 4, and which amplifies the received HF-signal and transmits it along the first (left) coaxial cable connector 18. The interlayer connection 14 can hereby contact the amplifier 16 directly, or preferably indirectly, via a circuit path/printed circuit board track of the upper printed circuit board 4.

As FIG. 1 shows, the coupling between the interlayer connection 14 and the lower antenna structure 12 is preferably not covered by an upper antenna structure 22. Preferably, this coupling is not covered by an upper substrate 21 either, so that this coupling may be used as a soldering point without a collision with the upper substrate 21 and the thus required provision of an appropriate recess in the upper substrate.

Attached to the lower patch-antenna 10 is an upper patch-antenna 20, which includes an upper substrate 21, an λ/2-antenna structure 22 disposed on the upper surface of the upper substrate 21, and an upper metallization 23 covering the entire lower surface of the upper substrate 21. The upper λ/2-antenna structure 22 is connected via an upper interlayer connection 24 directly or via the upper printed circuit board 4 to a second low-noise amplifier (LNA) 26, which is housed in an amplification chamber 8 disposed on the lower surface of the printed circuit board 4 and amplifies the received HF-signals, which it transmits to a second (right) coaxial cable connection 28.

An interlayer connection 19 running through the lower substrate 11 provides a galvanic connection between the lower λ/2-antenna structure 12 and the lower metallization 13, setting these at equal potential. The interlayer connection 19 is hereby provided preferably at the middle of the lower λ/2-antenna structure 12, where no significant voltage, yet maximum current of the induced HF-current, appears.

Portions of the low-noise amplifiers 16, 26 can also be disposed on the separate printed circuit board 3. The distribution of the amplifiers 16, 26 can be determined solely by the DC current supply or can even be configured for an entire or multiple HF-amplifier-levels. Alternatively, both amplifiers 16, 26 can be provided on separate printed circuit boards. If a DC voltage separation is present, a simple wire connection 32 can be provided between the two printed circuit boards 3 and 4 and serve as an electric connection.

The upper patch antenna 20 with the upper λ/2-antenna structure 22 is smaller than the lower patch antenna 10 with the lower λ/2-antenna structure 12, and by which good radiation properties of the λ/2-antennae 10, 20 can be achieved. In this configuration the upper patch antenna 20 is intended for reception of GPS-signals, while the lower patch antenna 10 can be employed for SDARS or DAB for example. Furthermore, the lower patch antenna 10 can also be employed for the reception of terrestrial signals, such as SDARS for example. Avantageously, the upper, smaller patch antenna 20 is employed for lower frequency bands and the lower patch antenna 10 is employed for higher frequency bands. By adjusting the dielectric constants $\epsilon_r$ accordingly, the frequency bands can freely set in principle. Therefore, the upper patch antenna 20 can also be employed for low frequency bands, if the dielectric constant $\epsilon_r$ of the upper substrate 21 is increased accordingly.

According to the invention, the metallization 23 of the upper patch antenna 20 can be omitted, thereby allowing the upper substrate 21 of the lower antenna structure 12 disposed thereunder to function as a metallization.

Figure 2:
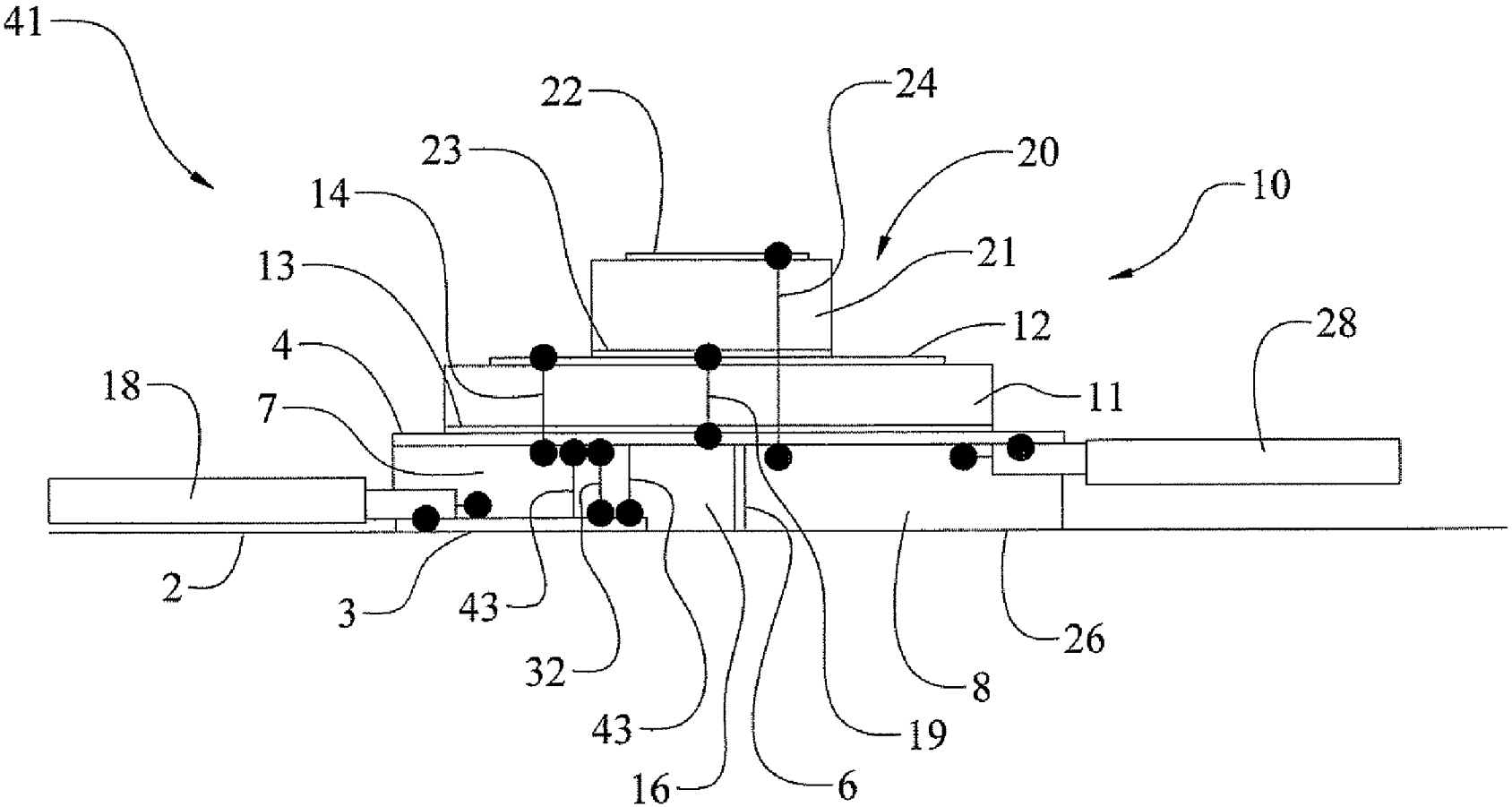
FIG. 2 shows the construction of an antenna module according to a further embodiment with amplifiers of the antennae elements provided on various printed circuit boards.

Antenna module 41 as shown in FIG. 2 has substantially the same construction as that shown in FIG. 1 and is therefore labeled identically. However, in this illustration the first (left) amplifier 16 is disposed on the lower printed circuit board 3. As an alternative to this embodiment, it is preferable if only the HF-portion of the first amplifier 16 is present on the separate, lower printed circuit board 3. In this manner, the HF-connection between the printed circuit boards 3 and 4 can be provided by a coaxial cable 43, for example.

Figure 3:
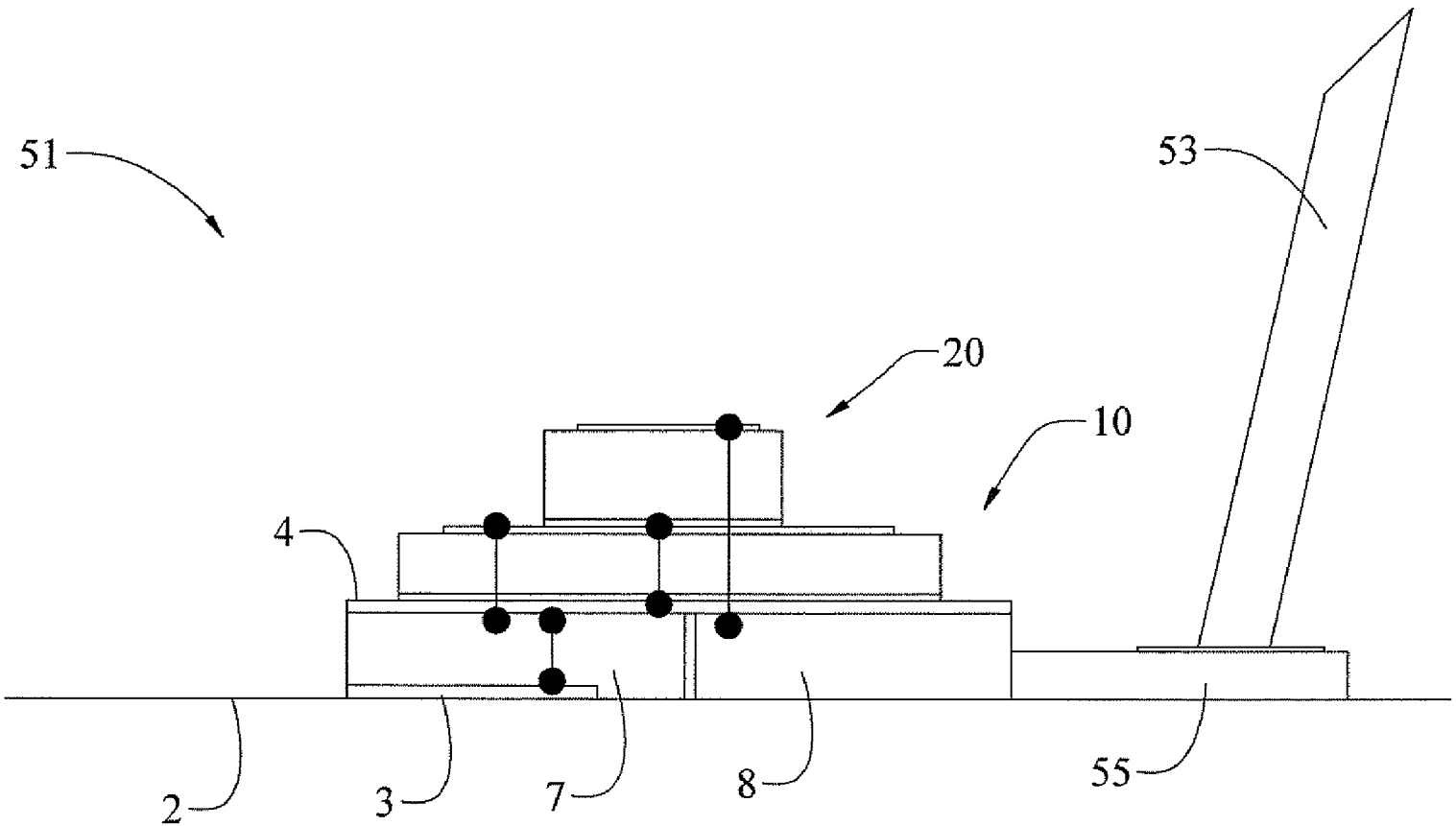
FIG. 3 shows the construction of an antenna module according to a further embodiment with an additional, substantially vertically oriented antenna for terrestrial signals.

FIG. 3 shows an antenna module 51, in which an antenna 53 is disposed laterally of the antenna modules 1 and 41 shown in FIGS. 1 and 2, respectively, and the antenna 53 is configured as a monopole or has a substantially vertical orientation. The antenna can be provided, for example, as a dual or multiband radio antenna, or an AM/FM-radio reception antenna, as well as a terrestrial DAB antenna (L-band or band III), or as a combination of these antennae.

A third amplifier 55 can be housed, for example, in a separate chamber below the antenna 53. The amplifiers 7, 8, and 55 can also share functions.

Figure 4:
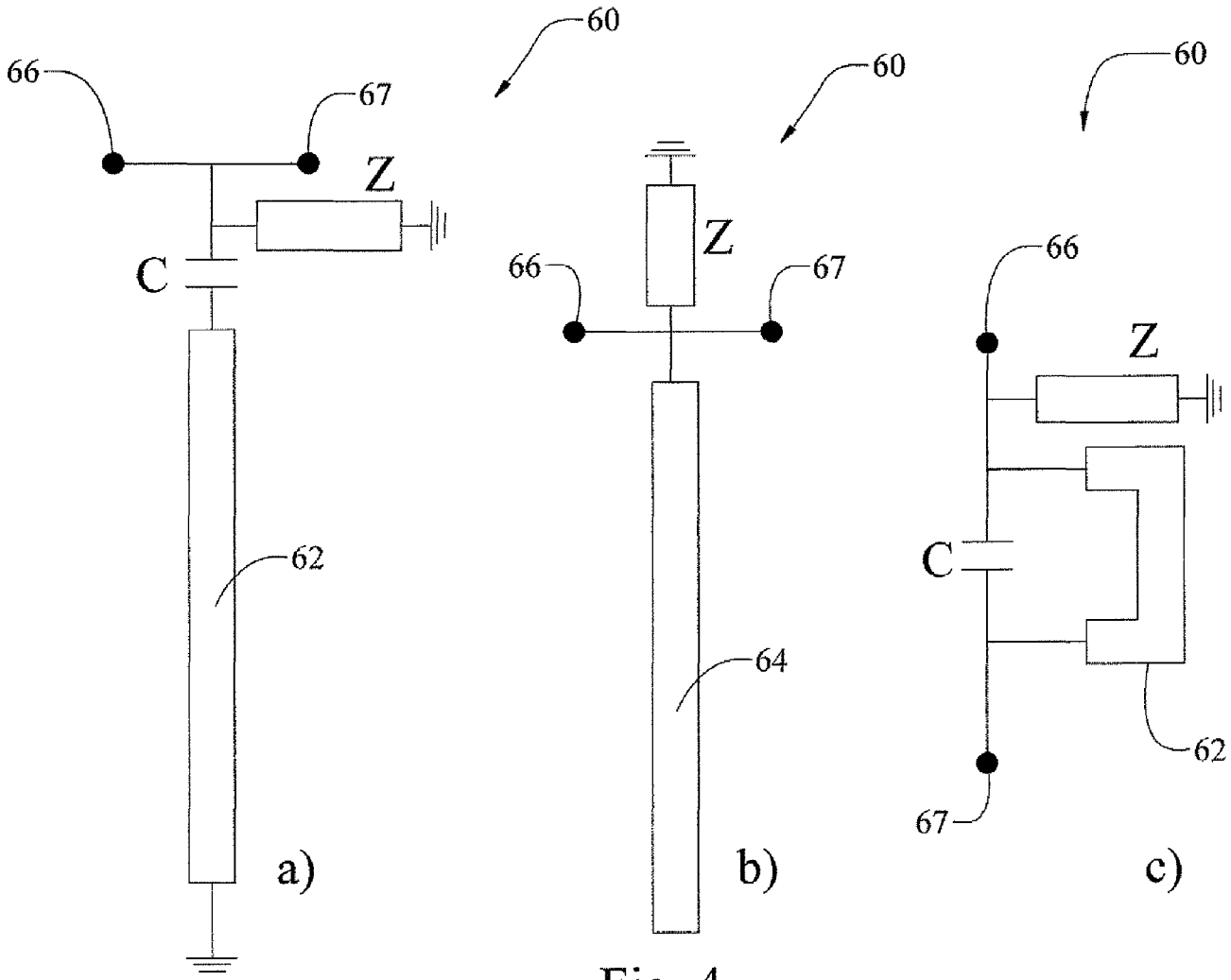
FIGS. 4*a-c* show various embodiments of band-blocking-filters for the antenna module of FIG. 3 for suppressing the transmission band of the terrestrial radio antenna.

FIGS. 4*a* through c show embodiments of a band-blocking-filter 60. This filter is configured to sufficiently suppress the transmitting band of the radio antenna 53, so that no interference is generated when radio and digital radio or GPS are operated simultaneously. Present as an inductor in the band-blocking-filter 60 is a conducting segment 62, which, together with a condenser C, forms a series connection in FIG. 4*a*, while forming a parallel connection in FIG. 4*c*. In FIG. 4*b* a conducting segment 64 is provided as a λ/4-conductor, which activates an empty-circuit-short-circuit transformation. A blind element Z can be provided according to its intended purpose and can be a condenser, a coil or a combination of such elements, in an appropriate connection. The band-blocking-filters 60 are each connected to the base of their respective antenna via their input 66 and are connected to the input of their respective amplifier via their output 67.

While this invention has been described as having a preferred design, it is understood that it is capable of further modifications, and uses and/or adaptations of the invention and following in general the principle of the invention and including such departures from the present disclosure as come within the known or customary practice in the art to which the invention pertains, and as may be applied to the central features hereinbefore set forth, and fall within the scope of the invention or limits of the claims appended hereto.

The invention claimed is:

1. Antenna module for frequencies in the GHz range and mountable on a motor vehicle, comprising:
   a) a lower patch-antenna including:
      i) a lower substrate including a dielectric material;
      ii) a lower λ/2-antenna structure provided on an upper surface of the lower substrate for reception of satellite transmitted frequencies in the GHz range; and
      iii) a lower metallization provided on a lower surface of the lower substrate;
   b) an upper patch-antenna provided on the lower patch-antenna, including:
      i) an upper substrate including a dielectric material;
      ii) an upper λ/2-antenna structure provided on an upper surface of the upper substrate for reception of satellite-transmitted frequencies in the GHz-range; and
      iii) a metallization provided on a lower surface of the upper substrate;
   c) a lower antenna connector running from the lower λ/2-antenna structure through the lower substrate; and
   d) an upper antenna connector separate from the lower antenna connector, and running from the upper λ/2-antenna structure through the upper substrate and the lower patch antenna; and
   e) the upper patch antenna being of smaller dimensions than those of the lower patch-antenna.

2. Antenna module as claimed in claim 1, wherein:
   a) below the lower patch antenna at least one amplification chamber is provided; and
   b) one of the antenna connectors is connected to an amplifier unit present in the at least one amplification chamber.

3. Antenna module as in claim 2, wherein:
   a) at least two amplification chambers are provided and are electromagnetically shielded by a metallic wall;
   b) a first one of the amplification chambers includes a first low-noise amplifier to receive the HF-signals of the lower λ/2-antenna structure via the lower antenna connector; and
   c) a second one of the amplification chambers includes a second low-noise amplifier to receive the HF-signals of the upper λ/2-antenna structure via the upper antenna connector.

4. Antenna module as in claim 1, wherein:
   a) the metallization provided on the lower surface of the upper substrate covers the entire lower surface of the upper substrate.

5. Antenna module as in claim 1, wherein:
   a) the lower λ/2-antenna structure of the lower patch antenna defines the metallization on the lower surface of the upper substrate.

6. Antenna module as in claim 1, wherein:
   a) the lower patch-antenna includes an interlayer connection which extends through the lower substrate and provides a galvanic connection between a zero-potential area of a middle lateral portion of the lower antenna structure and the lower metallization.

7. Antenna module as in claim 1, wherein:
   a) a ground plane is provided on which at least one amplification chamber is mounted; and
   b) the lower metallization of the lower patch-antenna includes a galvanic connection to the ground plane.

8. Antenna module as in claim 1, wherein:

a) the lower patch-antenna is disposed on a printed circuit board, on the lower surface of which amplifiers are present.

9. Antenna module as in claim 1, wherein:

a) the upper patch-antenna is configured for a higher frequency range than that of the lower patch-antenna.

10. Antenna module as in claim 1, wherein:

a) the upper substrate includes a higher dielectric constant than that of the lower substrate; and b) the upper patch-antenna is configured for a lower frequency range than that of the lower patch-antenna.

11. Antenna module as in claim 1, wherein:

a) a radiation pattern of the λ/2-antenna structure covers an elevation angle from 30° to 90°.

12. Antenna module as in claim 1, wherein: a) one of the two patch-antennas is configured as a transmission antenna, and the other of the two patch antennas is configured as a reception antenna.

13. Antenna module as in claim 1, wherein:

a) the antenna module is configured as an antenna array including a plurality of stacks arising from both the lower patch-antenna and the upper patch-antenna.

14. Antenna module as in claim 1, wherein:

a) the upper patch-antenna and the lower patch-antenna are connected in series.

15. Antenna module as in claim 1, wherein:

a) a coupling of the lower antenna connector to the lower λ/2-antenna structure is substantially free from being covered by the upper substrate.

16. Antenna module for frequencies in the GHz range and mountable on a motor vehicle, comprising:

a lower patch-antenna including:

a lower substrate including a dielectric material;

a lower λ/2-antenna structure provided on an upper surface of the lower substrate for reception of satellite transmitted frequencies in the GHz range; and a lower metallization provided on a lower surface of the lower substrate;

an upper patch-antenna provided on the lower patch-antenna, including:

an upper substrate including a dielectric material;

an upper λ/2-antenna structure provided on an upper surface of the upper substrate for reception of satellite-transmitted frequencies in the GHz-range; and a metallization provided on a lower surface of the upper substrate;

a lower antenna connector running from the lower λ/2-antenna structure through the lower substrate; and an upper antenna connector separate from the lower antenna connector, and running from the upper λ/2-antenna structure through the upper substrate and the lower patch antenna;

the upper patch antenna being of smaller dimensions than those of the lower patch-antenna;

the lower patch-antenna is disposed on a printed circuit board, on the lower surface of which amplifiers are present portions of the amplifier unit, including a direct current power supply, are present on at least one additional printed circuit board, the additional printed circuit board featuring one of a direct current wire connection and a high frequency connection, and the additional printed circuit board is present beneath the printed circuit board supporting the amplifier unit.

17. Antenna module for frequencies in the GHz range and mountable on a motor vehicle, comprising:

a lower patch-antenna including:

a lower substrate including a dielectric material;

a lower λ/2-antenna structure provided on an upper surface of the lower substrate for reception of satellite transmitted frequencies in the GHz range; and a lower metallization provided on a lower surface of the lower substrate;

an upper patch-antenna provided on the lower patch-antenna, including:

an upper substrate including a dielectric material;

an upper λ/2-antenna structure provided on an upper surface of the upper substrate for reception of satellite-transmitted frequencies in the GHz-range; and a metallization provided on a lower surface of the upper substrate;

a lower antenna connector running from the lower λ/2-antenna structure through the lower substrate; and an upper antenna connector separate from the lower antenna connector, and running from the upper λ/2-antenna structure through the upper substrate and the lower patch antenna;

the upper patch antenna being of smaller dimensions than those of the lower patch-antenna;

at least one of a monopole and a substantially vertical antenna is provided for reception of terrestrial signals.

18. Antenna module as in claim 17, wherein:

a) the at least one antenna is configured for at least one of the following functions: mobile telephone, AM/FM-radio-reception, DAB-band III, and terrestrial L-band DAB.

19. Antenna module as in claim 17, wherein:

a) the terrestrial antenna is configured for being placed in one of laterally relative to the patch-antennae and mounted thereon.

20. Antenna module as in claim 19, wherein:

a) at least one low-noise amplifier unit is provided that includes a band-blocking-filter for at least one of the transmission bands of the terrestrial antenna.

21. Antenna module as in claim 20, wherein:

a) the at least one of the band-blocking-filters is coupled to the base of the antenna by its input and to the input of the amplifier by its output.

22. Antenna module as in claim 20, wherein:

a) the at least one band-blocking-filter includes a conducting segment as an inductance.

23. Antenna module as in claim 22, wherein:

a) the conducting segment is designed as a λ/4-conductor for open circuit- and short circuit-transformation.

* * * * *

UNITED STATES PATENT AND TRADEMARK OFFICE

CERTIFICATE OF CORRECTION

PATENT NO. : 7,489,280 B2
APPLICATION NO. : 11/494533
DATED : February 10, 2009
INVENTOR(S) : Mehran Aminzadeh et al.

It is certified that error appears in the above-identified patent and that said Letters Patent is hereby corrected as shown below:

ON TITLE PAGE

Item (75)

Inventors:

4th line: *replace* "*Eildesheim (DE)*" *with* "*Hildesheim (DE)*";

Signed and Sealed this

Seventeenth Day of March, 2009

JOHN DOLL
*Acting Director of the United States Patent and Trademark Office*